US007441494B2

(12) United States Patent
Aulbach et al.

(10) Patent No.: US 7,441,494 B2
(45) Date of Patent: Oct. 28, 2008

(54) INDUSTRIAL TRUCK HAVING A LIFTING MAST AND TILTING CYLINDERS HAVING AN INTEGRATED HYDRAULIC DISTRIBUTOR

(75) Inventors: Holger Aulbach, Goldbach (DE); Peter Elsesser, Heinrichsthal (DE); Dieter Steigerwald, Heigenbrücken (DE); Walter Stenke, Kleinostheim (DE)

(73) Assignee: Linde Material Handling GmbH, Aschaffenburg (DE)

( * ) Notice: Subject to any disclaimer, the term of this patent is extended or adjusted under 35 U.S.C. 154(b) by 183 days.

(21) Appl. No.: 11/481,554

(22) Filed: Jul. 6, 2006

(65) Prior Publication Data

US 2007/0031230 A1 Feb. 8, 2007

(30) Foreign Application Priority Data

Jul. 7, 2005 (DE) ..... 10 2005 031 758

(51) Int. Cl.
*B66F 9/22* (2006.01)
*F15B 11/00* (2006.01)

(52) U.S. Cl. ..... 92/164; 414/640

(58) Field of Classification Search ..... 92/163, 92/164; 414/640
See application file for complete search history.

(56) References Cited

U.S. PATENT DOCUMENTS 2,473,659 A * 6/1949 Musgrave ..... 414/640
3,949,892 A * 4/1976 Ohms ..... 414/635
3,997,029 A * 12/1976 Evans ..... 414/635
4,395,189 A * 7/1983 Munten ..... 414/635
5,082,090 A * 1/1992 Walker ..... 414/631
5,094,143 A * 3/1992 Andersen, Jr. ..... 92/164
5,167,481 A 12/1992 Gotz

FOREIGN PATENT DOCUMENTS

DE 27 19 217 A1 11/1978

OTHER PUBLICATIONS

United Kingdom Patent Office Search Report dated Sep. 27, 2006.
Linde Material Handling GmbH & Co. KG, Designation Series 392 Industrial Truck, Sep. 15, 2006, Germany.

* cited by examiner

*Primary Examiner*—Thomas E Lazo
(74) *Attorney, Agent, or Firm*—The Webb Law Firm

(57) ABSTRACT

An industrial truck includes a tiltable lifting mast (1), a first tilting cylinder (2), and a second tilting cylinder (3). The two tilting cylinders (2, 3) are of double-acting design and are connected hydraulically in parallel. Two hydraulic lines (5, 6) are provided for the purpose of supplying hydraulic fluid to the tilting cylinders (2, 3). In order to simplify the design of the industrial truck, according to the invention the hydraulic lines (5, 6) open out at the cylinder base of the first tilting cylinder (2) and/or at a component (joint eye 10) adjacent thereto, the cylinder base and/or the component (joint eye 10) being formed at least partially as a hydraulic distributor.

7 Claims, 4 Drawing Sheets

INDUSTRIAL TRUCK HAVING A LIFTING MAST AND TILTING CYLINDERS HAVING AN INTEGRATED HYDRAULIC DISTRIBUTOR

CROSS-REFERENCE TO RELATED APPLICATION

This application claims priority to German Application No. 10 2005 031 758.8, filed Jul. 7, 2005, which application is herein incorporated by reference in its entirety.

BACKGROUND OF THE INVENTION

1. Field of the Invention

The invention relates to an industrial truck having a tiltable lifting mast, a first tilting cylinder, and a second tilting cylinder. The two tilting cylinders are of double-acting design and are connected hydraulically in parallel, with two hydraulic lines being provided for the purpose of supplying the tilting cylinders.

2. Technical Considerations

A generic industrial truck has been produced and marketed since 2002 in large numbers by Linde Material Handling under the designation Series 392. In this industrial truck, the tilting cylinders are arranged at the top, i.e., they connect the tiltable lifting mast in the upper region to a part of the vehicle frame which is in the form of a driver's cab. In order to supply the tilting cylinders, two supply lines are provided which open out at a distributor, which is fitted centrally between the tilting cylinders on the driver's protective roof of the driver's cab. From there, two head-side and two base-side supply branch lines lead to the two tilting cylinders, i.e., in each case, a head-side and a base-side supply branch line leads to the cylinder base and the cylinder head of the cylinder tube of the tilting cylinder.

The present invention is based on the object of providing an industrial truck of the type mentioned initially, which has a simpler design.

SUMMARY OF THE INVENTION

This object is achieved, according to the invention, by the fact that the hydraulic lines open out at the cylinder base of the first tilting cylinder and/or at a component adjacent thereto, the cylinder base and/or the component being formed at least partially as a hydraulic distributor.

Owing to the integration or partial integration of a hydraulic distributor in one of the tilting cylinders, the manufacturing and assembly complexity of the industrial truck according to the invention is reduced. A hoseline and a separate distributor element are dispensed with.

In accordance with one advantageous refinement of the invention, starting from the cylinder base of the first tilting cylinder or the component connected thereto, a base-side hydraulic branch line is passed to the cylinder base of the second tilting cylinder and a channel incorporated in the cylinder base or the component is passed to the base-side piston chamber of the first tilting cylinder, and two head-side hydraulic branch lines are passed firstly to the cylinder head side of the first tilting cylinder and secondly to the cylinder head side of the second tilting cylinder.

One development of the invention proposes arranging the tilting cylinders at the top, the cylinder tubes each being fixed in an articulated fashion to the lifting mast, and the piston rods each being fixed in an articulated fashion to a vehicle frame, and the distributor being integrated in a joint eye, which is connected to the cylinder tube of the first tilting cylinder.

BRIEF DESCRIPTION OF THE DRAWINGS

Further advantages and details of the invention will be explained in more detail with reference to the exemplary embodiment illustrated in the schematic figures, in which like reference numbers identify like parts throughout.

DESCRIPTION OF THE PREFERRED EMBODIMENTS

Figure 1:
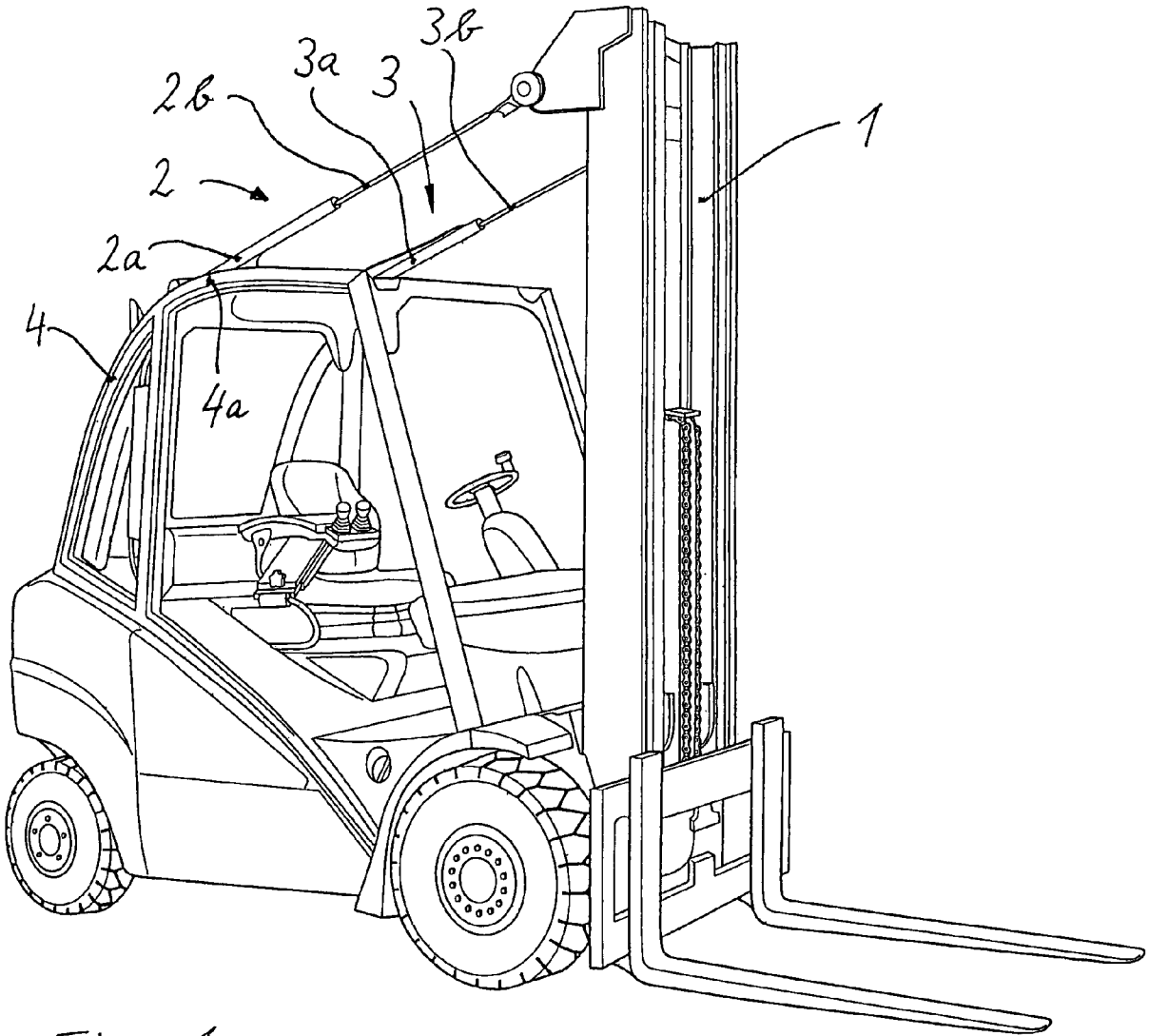
FIG. 1 shows a perspective view of an industrial truck.

The industrial truck illustrated in FIG. 1 is in the form of a forward-control fork-lift truck and has a lifting mast 1, which can be tilted by means of first and second tilting cylinders 2 and 3, respectively. The two double-acting tilting cylinders 2, 3 which are connected hydraulically in parallel are arranged at the top of the vehicle and are each coupled in an articulated fashion to the lifting mast 1 and a vehicle frame 4 in the region of a driver's protective roof 4*a*. In this case, a cylinder tube 2*a* or 3*a* of the tilting cylinder 2 or 3, respectively, is articulated on the driver's protective roof 4*a* of the vehicle frame 4, while a piston rod 2*b* or 3*b* of the tilting cylinder 2 or 3, respectively, is articulated on the lifting mast 1.

Figure 2:
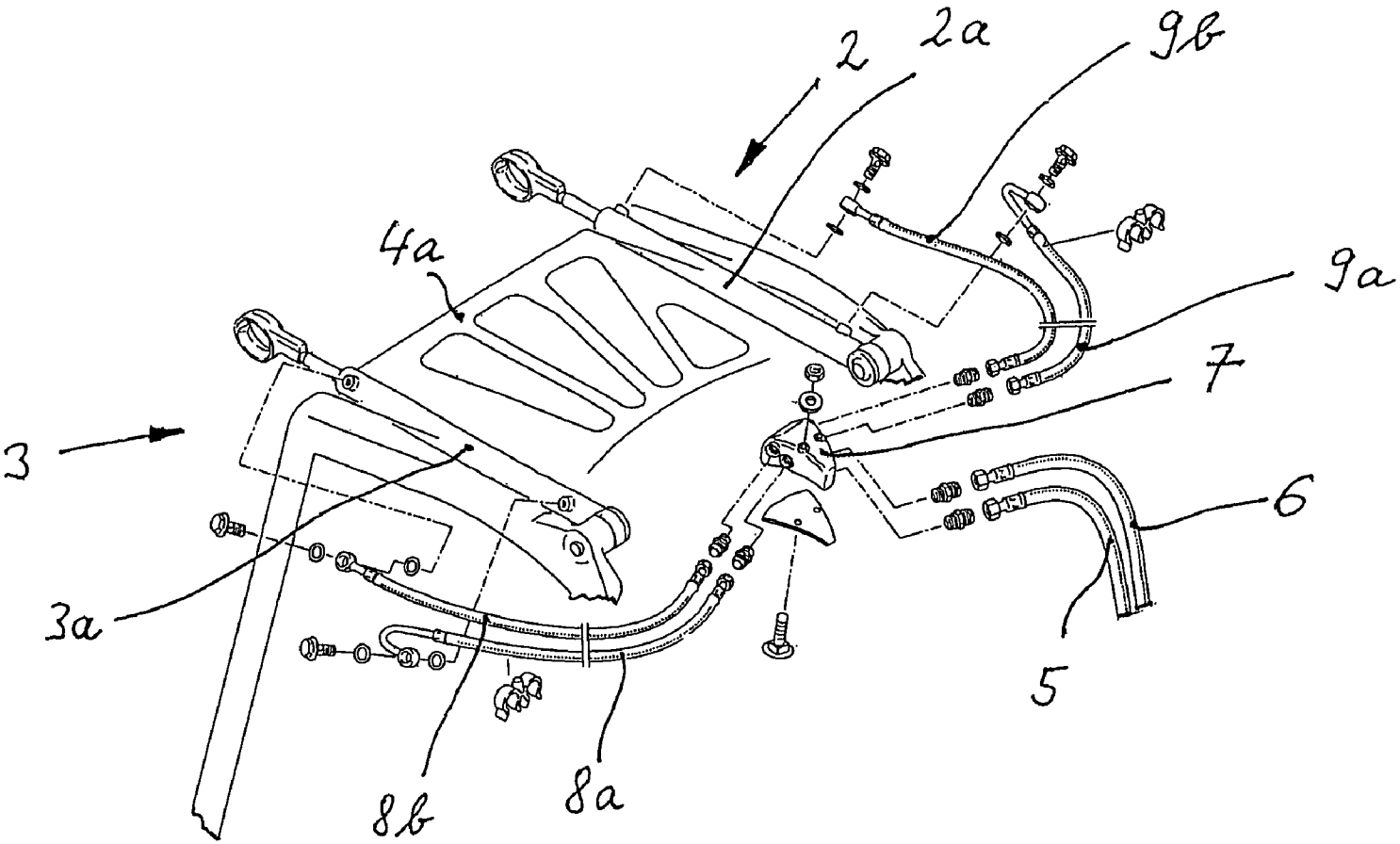
FIG. 2 shows an exploded illustration of the tilting cylinder arrangement of the industrial truck shown in FIG. 1.

As can be seen from FIG. 2, two hydraulic lines 5 and 6 are provided for the purpose of supplying hydraulic fluid to the tilting cylinders 2 and 3 and are connected, in the known art, to a hydraulic distributor 7, which is fixed centrally between the tilting cylinders 2 and 3 on a driver's protective roof 4*a* of the vehicle frame 4. Starting from the hydraulic distributor 7, in each case, one base-side hydraulic branch line 8*a* or 9*a*, which opens out in the region of the cylinder base of the cylinder tube 2*a* or 3*a*, and one head-side hydraulic branch line 8*b* or 9*b*, which opens out in the region of the cylinder head of the cylinder tube 2*a* or 3*a*, lead to each tilting cylinder 2 or 3.

Figure 3:
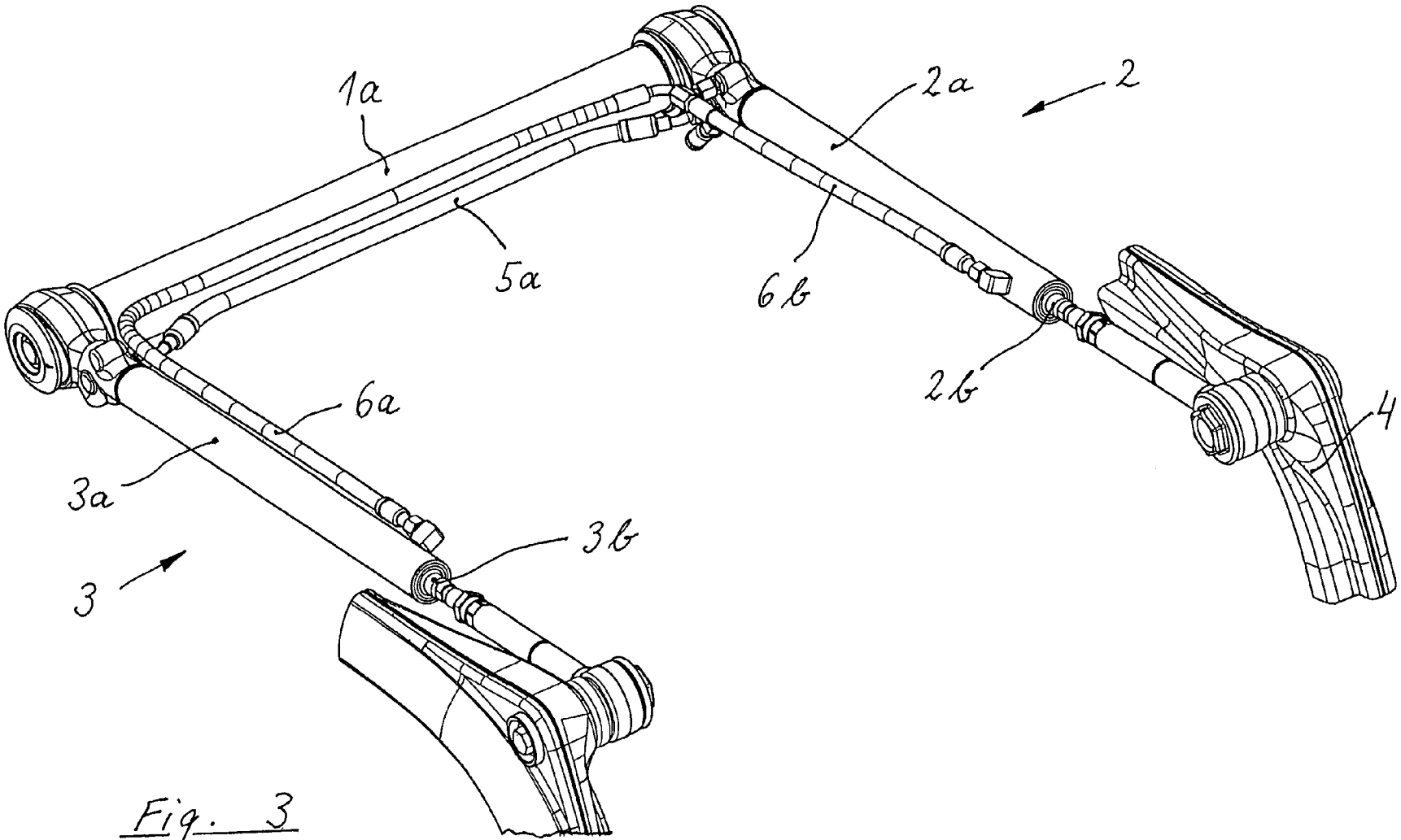
FIG. 3 shows a perspective illustration of the tilting cylinder arrangement of an industrial truck according to the invention.

The tilting cylinder arrangement illustrated in FIG. 3 of an industrial truck according to the invention differs from the arrangement shown in FIG. 2 firstly by the fact that the two tilting cylinders 2 and 3 are arranged the other way around, i.e., the cylinder tubes 2*a*, 3*a* are articulated on the lifting mast 1 (to be more precise on a transverse support 1*a* of the lifting mast 1), while the piston rods 2*b*, 3*b* are articulated on the driver's protective roof 4*a* and on the vehicle frame 4, respectively. This arrangement has the advantage that the piston rods 2*b*, 3*b* of the tilting cylinders 2, 3 are better protected against damage.

Figure 4:
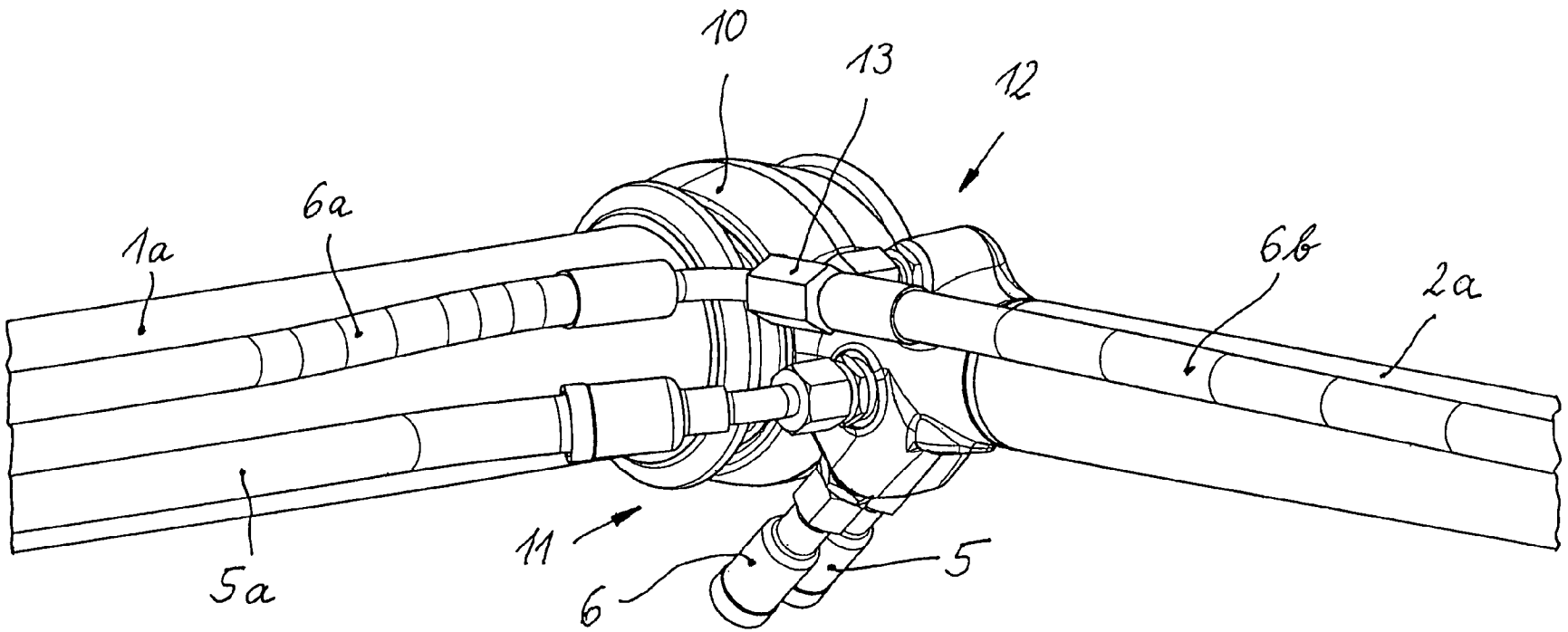
FIG. 4 shows an enlarged detail from FIG. 3.

In addition, no separate hydraulic distributor is provided. Rather, the two hydraulic lines 5 and 6 open out in the region of the cylinder base of the first tilting cylinder 2 (see also FIG. 4). There, a joint eye 10 is fixedly welded to the cylinder tube 2*a*, and the hydraulic distributor is integrated or partially integrated in the joint eye 10. In this case, a plurality of hydraulic channels (not illustrated in the figures) are incorporated in the joint eye 10.

One of the channels connects the hydraulic line 5 to a base-side piston chamber of the tilting cylinder 2 and furthermore to a connection hole 11, to which a base-side hydraulic branch line 5*a* is connected, which leads to the cylinder base of the second tilting cylinder 3. Another channel connects the hydraulic line 6 to a connection hole 12, to which two head-side hydraulic branch lines 6*a*, 6*b* are connected via a T piece 13, of which the hydraulic branch line 6*a* leads to the cylinder head of the second tilting cylinder 3 and the hydraulic branch line 6*b* leads to the cylinder head of the first tilting cylinder 2.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

What is claimed is:

1. An industrial truck, comprising:

a tiltable lifting mast;

a first tilting cylinder;

a second tilting cylinder, the two tilting cylinders being of double-acting design and being connected hydraulically in parallel; and two hydraulic lines provided for supplying the tilting cylinders, wherein the hydraulic lines are connected to a region of a cylinder base of the first tilting cylinder and are configured to open out at the cylinder base of the first tilting cylinder and/or at a component adjacent to the cylinder base, the cylinder base and/or the component being formed at least partially as a hydraulic distributor.

2. The industrial truck according to claim 1, wherein, starting from the cylinder base of the first tilting cylinder, a base-side hydraulic branch line is passed to a cylinder base of the second tilting cylinder and a channel incorporated in the cylinder base is passed to the base-side piston chamber of the first tilting cylinder, and two head-side hydraulic branch lines are passed firstly to the cylinder head side of the first tilting cylinder and secondly to the cylinder head side of the second tilting cylinder.

3. The industrial truck according to claim 1, wherein the tilting cylinders are arranged at a top of the truck, the cylinder tubes each being fixed in an articulated fashion to the lifting mast, and the piston rods each being fixed in an articulated fashion to a vehicle frame, and the distributor being integrated in a joint eye, which is connected to the cylinder tube of the first tilting cylinder.

4. The industrial truck according to claim 1, wherein the component is a joint eye.

5. The industrial truck according to claim 1, wherein, starting from the component adjacent to the cylinder base of the first tilting cylinder, a base-side hydraulic branch line is passed to a cylinder base of the second tilting cylinder and a channel incorporated in the component adjacent to the cylinder base is passed to the base-side piston chamber of the first tilting cylinder, and two head-side hydraulic branch lines are passed firstly to the cylinder head side of the first tilting cylinder and secondly to the cylinder head side of the second tilting cylinder.

6. An industrial truck, comprising:

a tiltable lifting mast;

a first tilting cylinder;

a second tilting cylinder, the two tilting cylinders being of double-acting design and being connected hydraulically in parallel; and two hydraulic lines provided for supplying the tilting cylinders, wherein the hydraulic lines open out at a cylinder base of the first tilting cylinder and/or at a component adjacent thereto, the cylinder base and/or the component being formed at least partially as a hydraulic distributor, and wherein the tilting cylinders are arranged at a top of the truck, the cylinder tubes each being fixed in an articulated fashion to the lifting mast, and the piston rods each being fixed in an articulated fashion to a vehicle frame, and the distributor being integrated in a joint eye, which is connected to the cylinder tube of the first tilting cylinder.

7. An industrial truck, comprising:

a tiltable lifting mast;

a first tilting cylinder;

a second tilting cylinder, the two tilting cylinders being of double-acting design and being connected hydraulically in parallel; and two hydraulic lines provided for supplying the tilting cylinders, wherein the hydraulic lines open out at a cylinder base of the first tilting cylinder and/or at a component adjacent thereto, the cylinder base and/or the component being formed at least partially as a hydraulic distributor, and wherein the component is a joint eye.

* * * * *